US008881361B1

(12) United States Patent
Gonzalez et al.

(10) Patent No.: US 8,881,361 B1
(45) Date of Patent: Nov. 11, 2014

(54) METHODS OF REPAIRING A ROTARY DRILL BIT

(75) Inventors: Jair J. Gonzalez, Provo, UT (US); Jed Clarke, Springville, UT (US); Neil Haddock, Orem, UT (US)

(73) Assignee: US Synthetic Corporation, Orem, UT (US)

( * ) Notice: Subject to any disclaimer, the term of this patent is extended or adjusted under 35 U.S.C. 154(b) by 162 days.

(21) Appl. No.: 13/413,100

(22) Filed: Mar. 6, 2012

Related U.S. Application Data

(63) Continuation of application No. 12/425,053, filed on Apr. 16, 2009, now Pat. No. 8,162,082.

(51) Int. Cl.
*E21B 10/55* (2006.01)

(52) U.S. Cl.
USPC ..... 29/402.07; 408/145; 76/108.2; 175/435

(58) Field of Classification Search
CPC ..... B23P 6/00; B21K 5/20; B21K 5/06; E21B 10/55
USPC ..... 29/402.01, 402.03, 402.08, 402.09, 29/402.016, 402.07; 408/713, 144, 145; 76/108.2; 175/435
See application file for complete search history.

(56) References Cited

U.S. PATENT DOCUMENTS

| | | | | |
|---|---|---|---|---|
| 1,887,372 | A * | 11/1932 | Emmons | 408/144 |
| 3,040,605 | A * | 6/1962 | Andreasson | 408/59 |
| 3,359,837 | A * | 12/1967 | Andreasson | 408/230 |
| 4,229,186 | A | 10/1980 | Wilson | |
| 4,255,165 | A | 3/1981 | Dennis et al. | |
| 4,268,276 | A | 5/1981 | Bovenkerk | |
| 4,274,900 | A | 6/1981 | Mueller et al. | |
| 4,410,054 | A | 10/1983 | Nagel | |
| 4,468,138 | A | 8/1984 | Nagel | |
| 4,560,014 | A | 12/1985 | Geczy | |
| 4,654,947 | A * | 4/1987 | Davis | 29/402.08 |
| 4,738,322 | A | 4/1988 | Hall et al. | |
| 4,811,801 | A | 3/1989 | Salesky et al. | |
| 4,850,523 | A | 7/1989 | Slutz | |
| 4,913,247 | A | 4/1990 | Jones | |
| 5,016,718 | A | 5/1991 | Tandberg | |
| 5,038,642 | A * | 8/1991 | Alverio et al. | 76/108.6 |
| 5,092,687 | A | 3/1992 | Hall | |
| 5,120,327 | A | 6/1992 | Dennis | |
| 5,135,061 | A | 8/1992 | Newton, Jr. | |
| 5,139,372 | A * | 8/1992 | Tanabe et al. | 407/118 |
| 5,154,245 | A | 10/1992 | Waldenstrom et al. | |
| 5,180,022 | A | 1/1993 | Brady | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,499,688 | A | 3/1996 | Dennis | |
| 5,544,713 | A | 8/1996 | Dennis | |

(Continued)

OTHER PUBLICATIONS

U.S. Appl. No. 12/425,053, Apr. 4, 2012, Issue Notification.

(Continued)

*Primary Examiner* — David Bryant
*Assistant Examiner* — Jason L Vaughan
(74) *Attorney, Agent, or Firm* — Dorsey & Whitney LLP

(57) ABSTRACT

Embodiments of the invention relate to superabrasive compacts including multiple superabrasive cutting portions and methods of repairing a rotary drill bit that employs at least one of such superabrasive compacts.

20 Claims, 11 Drawing Sheets

(56) References Cited

U.S. PATENT DOCUMENTS

| | | | | |
|---|---|---|---|---|
| 5,590,729 | A | 1/1997 | Cooley et al. | |
| 5,667,028 | A | 9/1997 | Truax et al. | |
| 5,722,499 | A | 3/1998 | Nguyen et al. | |
| 5,967,249 | A | 10/1999 | Butcher | |
| 6,029,544 | A * | 2/2000 | Katayama | 76/108.6 |
| 6,090,476 | A | 7/2000 | Thysell et al. | |
| 6,098,729 | A * | 8/2000 | Matthias | 175/420.1 |
| 6,182,533 | B1 * | 2/2001 | Tank | 76/108.1 |
| 6,258,139 | B1 | 7/2001 | Jensen | |
| 6,344,149 | B1 * | 2/2002 | Oles | 216/11 |
| 6,793,681 | B1 | 9/2004 | Pope et al. | |
| 7,234,550 | B2 * | 6/2007 | Azar et al. | 175/432 |
| 7,533,740 | B2 * | 5/2009 | Zhang et al. | 175/432 |
| 7,543,661 | B2 * | 6/2009 | Griffo et al. | 175/375 |
| 7,946,363 | B2 * | 5/2011 | Zhang et al. | 175/434 |
| 2005/0050801 | A1 * | 3/2005 | Cho et al. | 51/293 |
| 2005/0087371 | A1 * | 4/2005 | Kembaiyan | 175/435 |
| 2005/0183893 | A1 * | 8/2005 | Sjogren et al. | 175/426 |
| 2005/0210755 | A1 * | 9/2005 | Cho et al. | 51/293 |
| 2007/0278017 | A1 | 12/2007 | Shen et al. | |
| 2008/0230280 | A1 * | 9/2008 | Keshavan et al. | 175/434 |

OTHER PUBLICATIONS

U.S. Appl. No. 12/185,457, filed Aug. 4, 2008, Vail, et al.
U.S. Appl. No. 12/425,053, filed Apr. 16, 2009, Gonzalez et al.
U.S. Appl. No. 12/425,053, Apr. 4, 2011, Office Action.
U.S. Appl. No. 12/425,053, Oct. 24, 2011, Office Action.
U.S. Appl. No. 12/425,053, Dec. 22, 2011, Notice of Allowance.

* cited by examiner

METHODS OF REPAIRING A ROTARY DRILL BIT

CROSS-REFERENCE TO RELATED APPLICATIONS

This application is a continuation of U.S. application Ser. No. 12/425,053 filed on 16 Apr. 2009, the disclosure of which is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container or cartridge with a volume of diamond particles positioned on a surface of the cemented carbide substrate. A number of such cartridges may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

Despite the availability of a number of different PDCs, manufacturers and users of PDCs continue to seek PDCs that exhibit improved toughness, wear resistance, thermal stability, and/or increased operational lifetime.

SUMMARY

Embodiments of the invention relate to superabrasive compacts including multiple superabrasive cutting portions and methods of fabricating such superabrasive compacts. In an embodiment, a superabrasive compact comprises a cemented carbide substrate including a first interfacial surface and a second interfacial surface spaced from the first interfacial surface. A first superabrasive cutting portion may be bonded to the first interfacial surface of the cemented carbide substrate. The first superabrasive cutting portion includes a first working surface. A second superabrasive cutting portion may be bonded to the second interfacial surface of the cemented carbide substrate and spaced from the first superabrasive cutting portion. The second superabrasive cutting portion includes a second working surface that generally opposes the first working surface of the first superabrasive cutting portion.

Embodiments also include applications utilizing the disclosed superabrasive compacts in various articles and apparatuses, such as rotary drill bits, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to superabrasive compacts including multiple superabrasive cutting portions and methods of fabricating such superabrasive compacts. The operational lifetime of such superabrasive compacts may be enhanced because when one superabrasive cutting portion is worn, the other non-worn superabrasive cutting portion may be employed. The disclosed superabrasive compacts may be used in a variety of applications, such as rotary drill bits, machining equipment, and other articles and apparatuses.

Figure 1A:
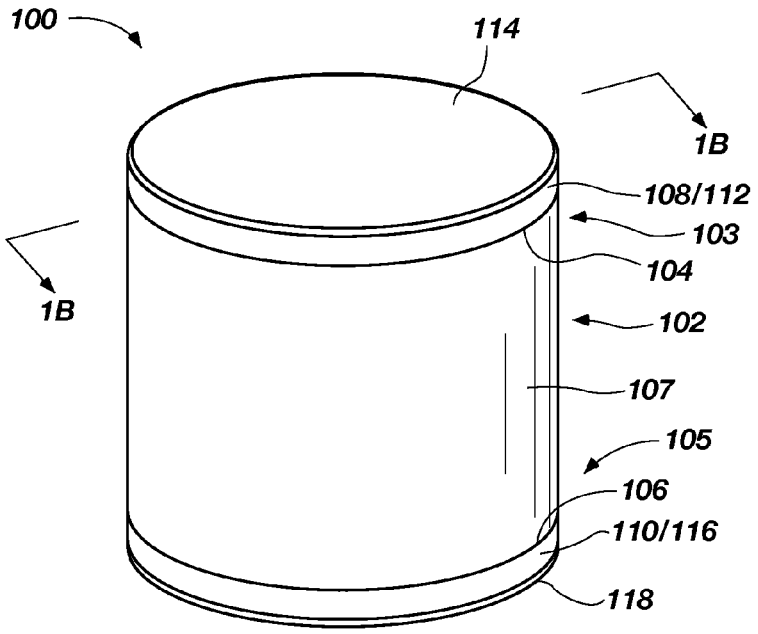
FIG. 1A is an isometric view of a superabrasive compact including first and second spaced superabrasive cutting portions according to an embodiment.
Figure 1B:
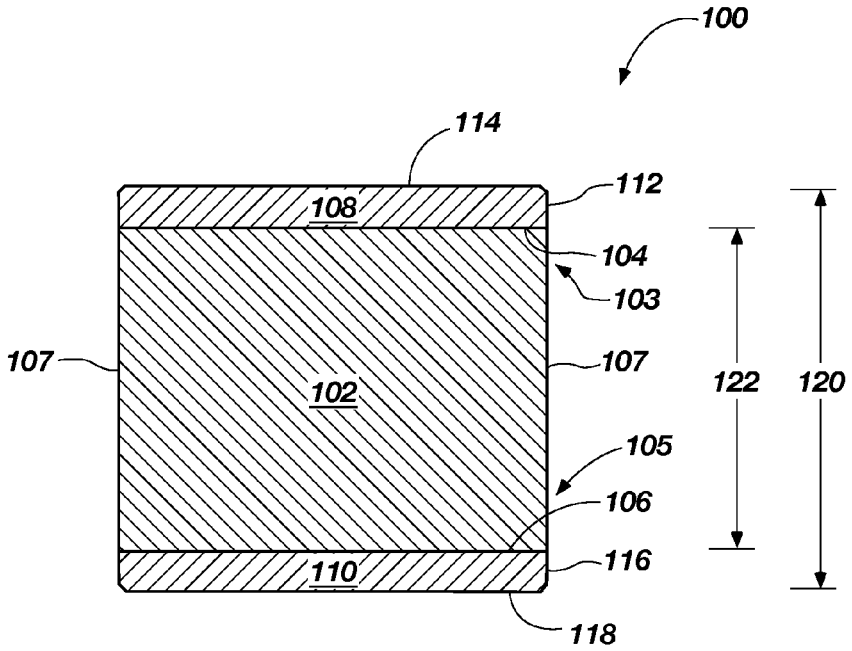
FIG. 1B is a cross-sectional view of the superabrasive compact shown in FIG. 1A taken along line 1B-1B.

FIGS. 1A and 1B are isometric and cross-sectional views, respectively, of a superabrasive compact 100 including multiple superabrasive cutting portions according to an embodiment. The superabrasive compact 100 may exhibit an enhanced operational lifetime compared to a single-superabrasive cutting portion superabrasive compact because when one superabrasive cutting portion is worn, the other non-worn superabrasive cutting portion may be employed. The superabrasive compact 100 comprises a cemented carbide substrate 102 including a first end region 103 having a first interfacial surface 104 and a second end region 105 spaced (e.g., longitudinally spaced) from the first end region 103 and having a second interfacial surface 106 that generally opposes the first interfacial surface 104. The cemented carbide substrate 102 includes at least one peripheral surface 107 that extends between the first and second interfacial surfaces 104 and 106. The cemented carbide substrate 102 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in an embodiment, the cemented carbide substrate 102 comprises cobalt-cemented tungsten carbide.

The superabrasive compact 100 includes a first superabrasive cutting portion 108 that is bonded to and may extend laterally over substantially all of the first interfacial surface 104, and a second superabrasive cutting portion 110 that is bonded to and may extend laterally over substantially all of the second interfacial surface 106. In the illustrated embodiment, each of the first and second interfacial surfaces 104 and 106 exhibits a substantially planar topography. However, in other embodiments, each of the first and second interfacial surfaces 104 and 106 may exhibit a nonplanar topography, and an interfacial surface of the first superabrasive cutting portion 108 and an interfacial surface of the second superabrasive cutting portion 110 may each exhibit a correspondingly configured nonplanar topography. Furthermore, although the superabrasive compact 100 is illustrated as being cylindrical, the superabrasive compacts disclosed herein may depart from being cylindrical and may exhibit any suitable geometry.

The first superabrasive cutting portion 108 includes at least one lateral surface 112 and a working, front surface 114. The second superabrasive cutting portion 110 includes at least one lateral surface 116 and a working, front surface 118 that faces generally away (e.g., generally opposing) from the front surface 114 of the superabrasive cutting portion 108. Although the front surfaces 112 and 114 are illustrated as being generally planar, the front surfaces 112 and 114 may be concave, convex, or another suitable geometry. Although not illustrated, each of the first and second superabrasive cutting portions 108 and 110 may include an edge chamfer or any desired edge geometry (e.g., a radius, multiple chamfers, etc.), if desired. It is noted that at least a portion of the at least one lateral surfaces 112 and 116 may also function as a working surface that contacts a subterranean formation during drilling operations. In fact, any surface of the first and second superabrasive portions 108 and 110 that, in operation, contacts an object to be worked may be considered a working surface.

It is noted that the superabrasive compact 100 may be free of superabrasive structures (e.g., a PCD structure) disposed on or in the at least one peripheral surface 107 of the cemented carbide substrate 102 that extends between the first and second interfacial surfaces 104 and 106. However, in some embodiments, a superabrasive structure (e.g., a PCD structure) may be disposed on or in the at least one peripheral surface 107 to further enhance the operational lifetime of the PDC 100.

The superabrasive cutting portions 108 and 110 may be made from a number of different superabrasive materials, such as PCD, polycrystalline cubic boron nitride, silicon carbide, diamond grains bonded together with silicon carbide, or combinations of the foregoing. In an embodiment, the first and second superabrasive cutting portions 108 and 110 each is a PCD table that includes a plurality of directly bonded-together diamond grains exhibiting diamond-to-diamond bonding therebetween (e.g., $sp^3$ bonding), which define a plurality of interstitial regions. A portion of or substantially all of the interstitial regions of the first and second superabrasive cutting portions 108 and 110 may include a metal-solvent catalyst disposed therein that is infiltrated from the cemented carbide substrate 102 or another source. For example, the metal-solvent catalyst may be selected from iron, nickel, cobalt, and alloys of the foregoing metals.

In an embodiment, the first and second superabrasive cutting portions 108 and 110 may each be integrally formed with the cemented carbide substrate 102. For example, the first and second superabrasive cutting portions 108 and 110 may each be a PCD table that is integrally formed with the cemented carbide substrate 102. In such an embodiment, the infiltrated metal-solvent catalyst is used to catalyze formation of the first and second superabrasive cutting portions 108 and 110 from diamond powder during HPHT processing. In another embodiment, the first and second superabrasive cutting portions 108 and 110 may each be a pre-sintered superabrasive cutting portion that has been HPHT bonded to the cemented carbide substrate 102 in a second HPHT process after being initially formed in a first HPHT process. For example, the first and second superabrasive cutting portions 108 and 110 may each be a pre-sintered PCD cutting portion that has been HPHT bonded to the cemented carbide substrate 102. In yet another embodiment, one of the first and second superabrasive cutting portions 108 and 110 may be integrally formed with the cemented carbide substrate 102, while the other one of the first and second superabrasive cutting portions 108 and 110 may be a pre-sintered superabrasive cutting portion.

Referring specifically to FIG. 1B, the first and second superabrasive cutting portions 108 and 110 may be spaced from each other to define a dimension 120 of the superabrasive compact 100, such as a maximum longitudinal dimension. The cemented carbide substrate 102 may also be dimensioned so that the first and second superabrasive cutting portions 108 and 110 are spaced from each other a dimension 122. For example, the dimension 122 may be at least about 5 mm, such as about 7 mm to about 15 mm or about 10 mm to about 14 mm. The dimension 122 and the volume of the cemented carbide substrate 102 may be chosen so that residual tensile stresses that may develop in the cemented carbide substrate 102 when the first and second superabrasive cutting portions 108 and 110 are integrally formed therewith in an HPHT process or bonded thereto are below a selected magnitude.

Figure 1C:
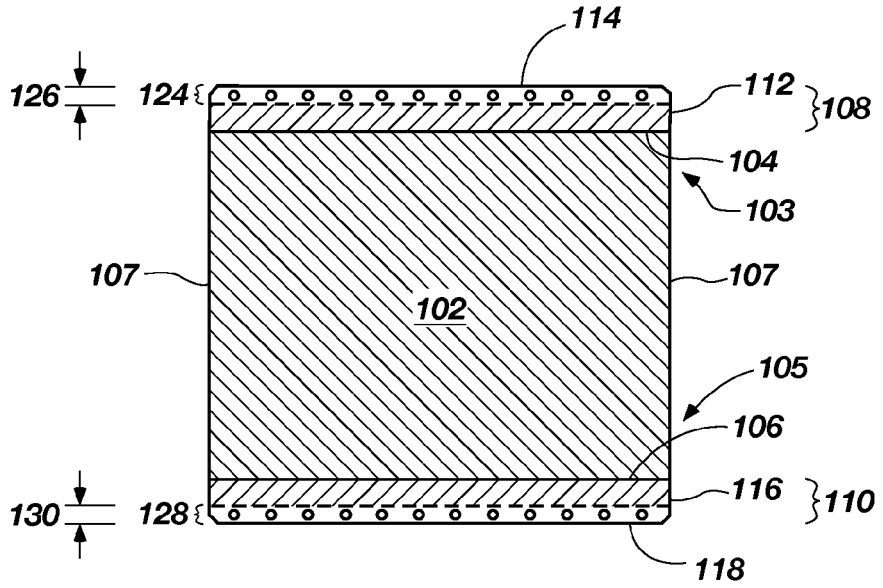
FIG. 1C is a cross-sectional view of the superabrasive compact shown in FIG. 1A after the first and second superabrasive cutting portions have been leached to remove at least a portion of the metal-solvent catalyst therefrom according to an embodiment.

Referring to FIG. 1C, in an embodiment, when the first superabrasive cutting portion 108 and the second superabrasive cutting portion 110 each is a PCD cutting portion, at least one of the first superabrasive cutting portion 108 or the second superabrasive cutting portion 110 may be leached to remove at least a portion of the metal-solvent catalyst therefrom so that the thermal stability of the first and second superabrasive cutting portions 108 and 110 may be enhanced. FIG. 1C is a cross-sectional view of the superabrasive compact 100 shown in FIG. 1A after the first and second superabrasive cutting portions 108 and 110 have been leached according to an embodiment. For example, the leaching may be performed in a suitable acid, such as aqua regia, nitric acid, hydrofluoric acid, or mixtures of the foregoing. After being leached, the first superabrasive cutting portion 108 includes a first leached region 124 that extends from the front surface 114 to a depth 126 therein, while an underlying region of the first superabrasive cutting portion 108 is relatively unaffected by the leaching. The second superabrasive cutting portion 110 includes a second leached region 128 that extends from the front surface 118 to a depth 130 therein, while an underlying region of the second superabrasive cutting portion 110 is relatively unaffected by the leaching. For example, the depths 126 and 130 may each be about 10 μm to about 500 μm. In various embodiments, the depths 126 and 130 may each be about 50 μm to about 100 μm or about 200 μm to about 350 μm.

Figure 1D:
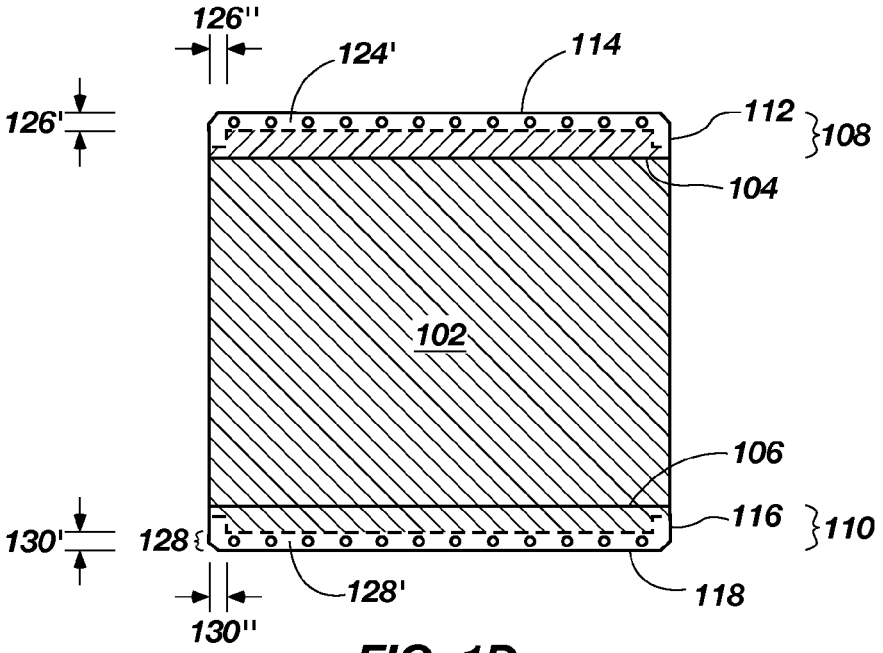
FIG. 1D is a cross-sectional view of the superabrasive compact shown in FIG. 1A after the first and second superabrasive cutting portions have been leached to remove at least a portion of the metal-solvent catalyst therefrom according to another embodiment.

FIG. 1D is a cross-sectional view of the superabrasive compact 100 shown in FIG. 1A after the first and second superabrasive cutting portions 108 and 110 have been leached according to another embodiment. In the embodiment illustrated in FIG. 1D, a leached region 124' may extend inwardly from the front surface 114 of the first superabrasive cutting portion 108 to a depth 126' and may extend laterally from the at least one lateral surface 112 to a distance 126" that may be equal to or less than the depth 126'. A leached region 128' may extend inwardly from the front surface 118 of the second superabrasive cutting portion 110 to a depth 130' and may extend laterally from the at least one lateral surface 116 to a distance 130" that may be equal to or less than the depth 130'.

Figure 2A:
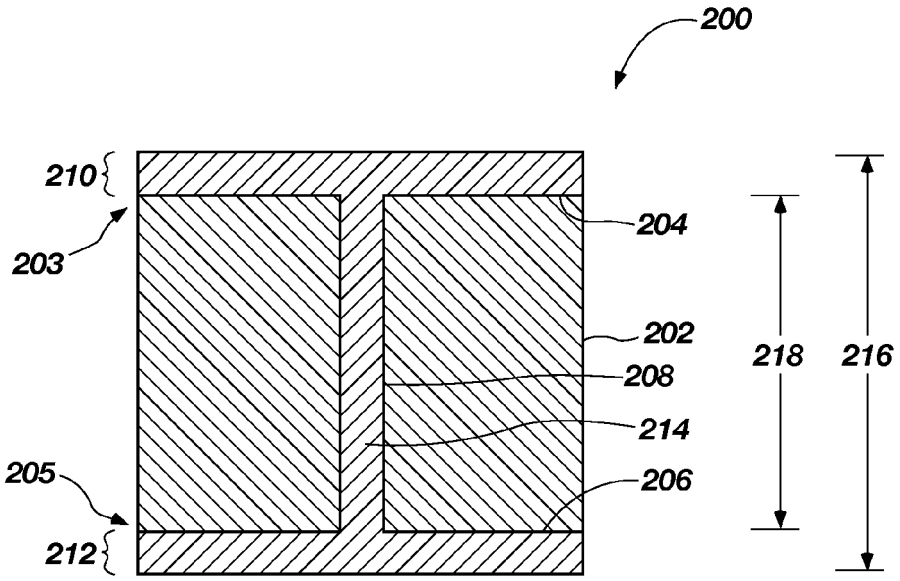
FIG. 2A is a cross-sectional view of a superabrasive compact including first and second spaced superabrasive cutting portions interconnected by a superabrasive core according to an embodiment.

FIG. 2A is a cross-sectional view of a superabrasive compact 200 including multiple superabrasive cutting portions interconnected by a superabrasive core that may promote efficient heat transfer between the superabrasive cutting portions and/or improve structural integrity of the superabrasive compact 200 according to an embodiment. The superabrasive compact 200 comprises a cemented carbide substrate 202 including a first end region 203 having a first interfacial surface 204 and a second end region 205 spaced from the first end region 203 and having a second interfacial surface 206. A through hole 208 extends between the first and second interfacial surfaces 204 and 206. In an embodiment, the through hole 208 may be generally centrally located in the cemented carbide substrate 202. The cemented carbide substrate 202 may be made from the same materials as the cemented carbide substrate 102.

A first superabrasive cutting portion 210 is bonded to and may extend laterally over substantially all of the first interfacial surface 204, and a second superabrasive cutting portion 212 is bonded to and may extend laterally over substantially all of the second interfacial surface 206. A superabrasive core 214 extends through the through hole 208 and interconnects the first and second PCD cutting portions 210 and 212 thermally and physically. The superabrasive core 214 may promote efficient heat transfer from the first superabrasive cutting portion 210 to the second superabrasive cutting portion 212 and vice versa to help prevent thermal degradation of, for example, diamond grains in the first and second superabrasive cutting portions 210 and 212 at high temperatures typically experienced when the superabrasive compact 200 is used as a cutting element for drilling a subterranean formation.

The first and second superabrasive cutting portions 210 and 212 may be spaced from each other to define a dimension 216 of the superabrasive compact 200, such as a maximum longitudinal dimension. The cemented carbide substrate 202 may also be dimensioned so that the first and second superabrasive cutting portions 210 and 212 are spaced from each other a dimension 218. For example, the dimension 218 may be at least about 5 mm, such as about 7 mm to about 15 mm or about 10 mm to about 14 mm.

In an embodiment, the first superabrasive cutting portion 210, the second superabrasive cutting portion 212, and the superabrasive core 214 may be PCD integrally formed with each other and include a metal-solvent catalyst disposed interstitially between directly bonded-together diamond grains thereof. For example, the metal-solvent catalyst may be infiltrated from the cemented carbide substrate 202 during HPHT processing to catalyze formation of the PCD that forms the first superabrasive cutting portion 210, the second superabrasive cutting portion 212, and the superabrasive core 214. In another embodiment, one or both of the first and second superabrasive cutting portions 210 and 212 may be a pre-sintered PCD cutting portion and the superabrasive core 214 may be separately formed PCD core that is bonded to the pre-sintered PCD cutting portions during HPHT bonding of the pre-sintered PCD cutting portions to the cemented carbide substrate 202.

Figure 2B:
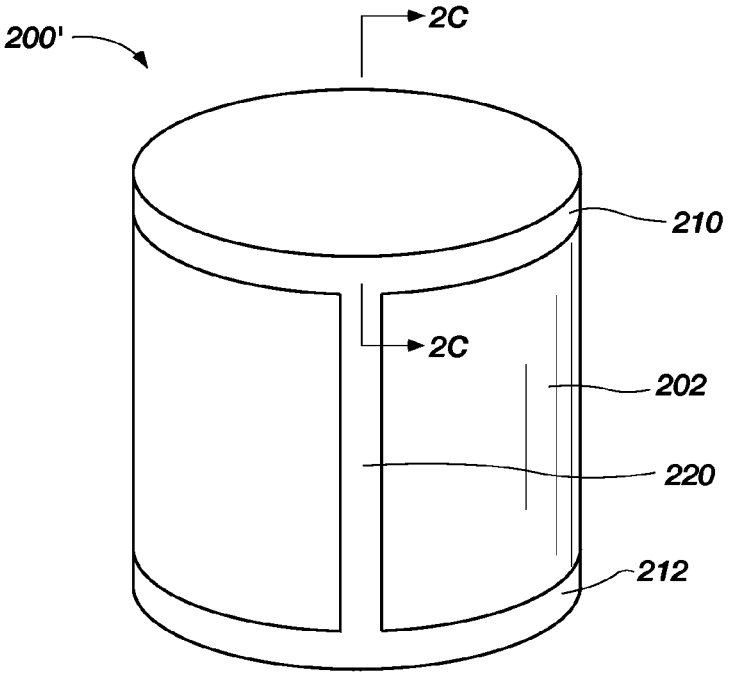
FIG. 2B is an isometric view of a superabrasive compact according to another embodiment, which also includes a superabrasive core.
Figure 2C:
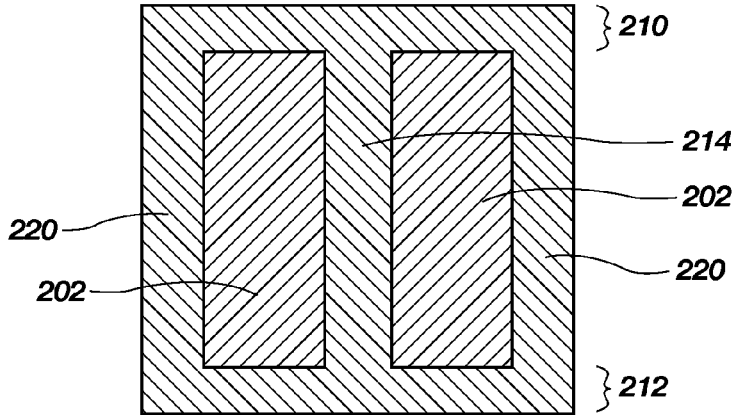
FIG. 2C is a cross-sectional view of the superabrasive compact shown in FIG. 1A taken along line 2C-2C.
Figure 2D:
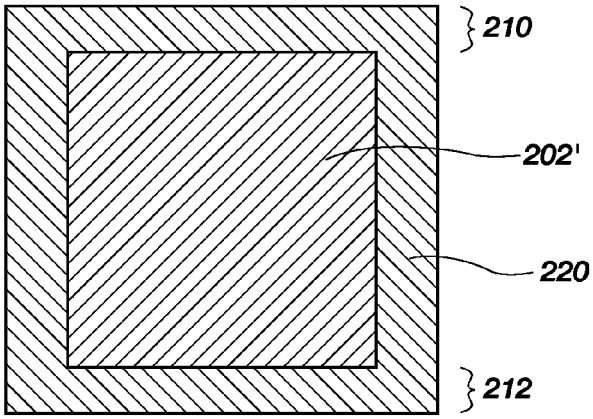
FIG. 2D is a cross-sectional view of a superabrasive compact according to yet another embodiment.

FIGS. 2B-2C are isometric and cross-sectional views, respectively, of a superabrasive compact 200' according to another embodiment. The superabrasive compact 200' differs mainly from the superabrasive compact 200 shown in FIG. 2A in that two or more superabrasive portions 220, which may be made from any of the disclosed superabrasive materials, extend lengthwise in corresponding grooves formed in the substrate 202 between the superabrasive cutting portions 210 and 212. According to various embodiments, the superabrasive cutting portions 210 and 212, superabrasive core 214, and superabrasive portions 220 may be separately formed or integrally formed with each other. Referring to FIG. 2D, in yet another embodiment, the superabrasive core 214 may be omitted, if desired, and a cemented carbide substrate 202' may lack a through hole extending therethrough.

Figure 3:
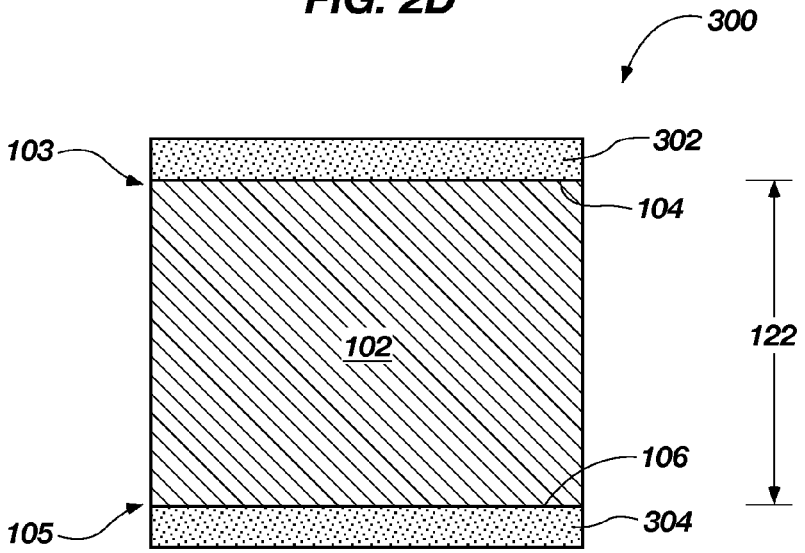
FIG. 3 is a cross-sectional view of an assembly to be HPHT processed to form the superabrasive compact shown in FIGS. 1A and 1B according to an embodiment.

FIG. 3 is a cross-sectional view of an assembly 300 to be HPHT processed to form the superabrasive compact 100 shown in FIGS. 1A and 1B according to an embodiment. A first superabrasive mass 302 including a plurality of superabrasive particles (e.g., a plurality of diamond particles and/or cubic boron nitride particles) may be positioned adjacent to the first interfacial surface 104 of the first end region 103 of the cemented carbide substrate 102. A second superabrasive mass 304 including a plurality of superabrasive particles (e.g., a plurality of diamond particles and/or cubic boron nitride particles) may also be positioned adjacent to the second interfacial surface 106 of the second end region 105 of the cemented carbide substrate 102. The first interfacial surface 104 is spaced from the second interfacial surface 106 by the dimension 122.

The plurality of superabrasive particles of each of the first and second superabrasive masses 302 and 304 may exhibit one or more selected sizes. The one or more selected sizes may be determined, for example, by passing the superabrasive particles through one or more sizing sieves or by any other method. In an embodiment, the plurality of superabrasive particles of each of the first and second superabrasive masses 302 and 304 may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of superabrasive particles of each of the first and second superabrasive masses 302 and 304 may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of superabrasive particles of each of the first and second superabrasive masses 302 and 304 may include a portion exhibiting a relatively larger size between about 40 μm and about 15 μm and another portion exhibiting a relatively smaller size between about 12 μm and 2 μm. Of course, the plurality of superabrasive particles of each of the first and second superabrasive masses 302 and 304 may also include three or more different sizes (e.g., one relatively larger size and two or more relatively smaller sizes) without limitation.

The assembly 300 may be placed in a pressure transmitting medium, such as a refractory metal can embedded in pyrophyllite or other pressure transmitting medium. The pressure transmitting medium, including the cemented carbide substrate 102 and the first and second superabrasive masses 302 and 304 therein, may be subjected to a HPHT process using an ultra-high pressure press to create temperature and pressure conditions at which, for example, diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 8.0 GPa) for a time sufficient to, for example, sinter the superabrasive particles of the first and second superabrasive masses 302 and 304 to form the corresponding first and second superabrasive cutting portions 108 and 110 (FIGS. 1A and 1B) therefrom. For example, the pressure of the HPHT process may be about 5 GPa to about 7 GPa and the temperature of the HPHT process may be about 1150° C. to about 1450° C. (e.g., about 1200° C. to about 1400° C.). Upon cooling from the HPHT process, first and second superabrasive cutting portions 108 and 110 shown in FIGS. 1A and 1B become metallurgically bonded to the cemented carbide substrate 102.

During the HPHT process, a metal-solvent catalyst from the cemented carbide substrate 102 or another source may liquefy and infiltrate into the superabrasive particles of the first and second superabrasive masses 302 and 304. When the superabrasive particles are diamond particles, the infiltrated metal-solvent catalyst may function as a catalyst that catalyzes formation of directly bonded-together diamond grains from the diamond particles to form the first and second superabrasive cutting portions 108 and 110 (FIGS. 1A and 1B). For example, cobalt from a cobalt-cemented tungsten carbide substrate may infiltrate into the diamond particles of the first and second superabrasive masses 302 and 304 to catalyze formation of PCD.

Figure 4:
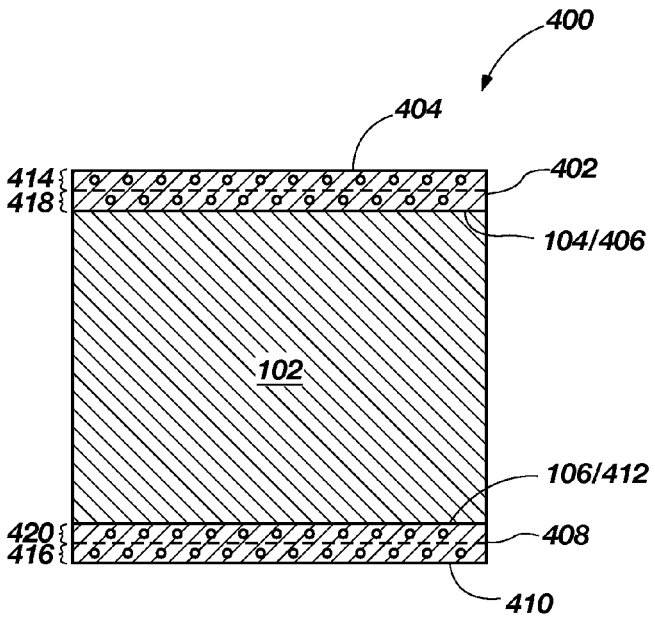
FIG. 4 is a cross-sectional view of an assembly to be HPHT processed to form a superabrasive compact including first and second pre-sintered PCD cutting portions according to an embodiment.

Referring to FIG. 4, in another embodiment, the first and second superabrasive masses may be at least partially leached PCD cutting portions. FIG. 4 is a cross-sectional view of an assembly 400 to be HPHT processed to form the superabrasive compact 100 when the first and second superabrasive cutting portions 108 and 110 (FIGS. 1A and 1B) are pre-sintered PCD cutting portions. The assembly 400 comprises a first at least partially leached PCD cutting portion 402 including a front surface 404 and a back surface 406, and a second at least partially leached PCD 408 including a front surface 410 and a back surface 412. The first and second at least partially leached PCD cutting portions 402 and 408 each includes a plurality of directly bonded-together diamond grains defining interstitial regions that form a network of at least partially interconnected pores that enable fluid to flow from one side to the other side (e.g., between the front surface 404 and the back surface 406). The back surface 406 of the first at least partially leached PCD cutting portion 402 is positioned adjacent to the first interfacial surface 104 of the cemented carbide substrate 102 and the back surface 412 of the second at least partially leached PCD cutting portion 408 is positioned adjacent to the second interfacial surface 106 of the cemented carbide substrate 102.

The assembly 400 may be placed in a pressure transmitting medium, such as a refractory metal can embedded in pyrophyllite or other pressure transmitting medium. The pressure transmitting medium, including the assembly 400, may be subjected to a HPHT process using an ultra-high pressure press to create temperature and pressure conditions at which diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 8.0 GPa) so that the metal-solvent catalyst in the cemented carbide substrate 102 may be liquefied and infiltrate into the first and second at least partially leached PCD cutting portions 402 and 404. For example, the pressure of the HPHT process may be about 5 GPa to about 7 GPa and the temperature of the HPHT process may be about 1150° C. to about 1450° C. (e.g., about 1200° C. to about 1400° C.). Upon cooling from the HPHT process, in an embodiment, the infiltrated PCD cutting portions represented in an embodiment as the superabrasive cutting portions 108 and 110 in FIGS. 1A and 1B become bonded to the cemented carbide substrate 102. In another embodiment, one of the superabrasive cutting portions 108 and 110 may be pre-sintered, while the other one of the superabrasive cutting portions 108 and 110 may be sintered during the HPHT cycle so that it is integrally formed with the cemented carbide substrate 102.

In one embodiment, the HPHT process conditions may be accurately controlled so that the metal-solvent catalyst from the cemented carbide substrate 102 only partially infiltrates each of the first and second at least partially leached PCD cutting portions 402 and 408. For example, the interstitial regions of a region 414 of the first at least partially leached PCD cutting portion 402 and the interstitial regions of a region 416 of the second at least partially leached PCD cutting portion 408 may remain un-infiltrated by the metal-solvent catalyst, while the interstitial regions of a region 418 of the first at least partially leached PCD cutting portion 402 and the interstitial region of a region 420 of the second at least partially leached PCD cutting portion 408 may be filled with the metal-solvent catalyst. The region that the metal-solvent catalyst infiltrates into the first and second at least partially leached PCD cutting portions 402 and 408 may be controlled by selecting the pressure, temperature, and/or process time employed in the HPHT process. In one embodiment, the assembly 400 may be subjected to a temperature of about 1150° C. to about 1300° C. (e.g., about 1270° C. to about 1300° C.) and a corresponding pressure that is within the diamond stable region, such as about 5.0 GPa. Such temperature and pressure conditions are lower than temperature and pressure conditions typically used to fully infiltrate the first and second at least partially leached PCD cutting portions 402 and 408.

In other embodiments, the metal-solvent catalyst from the cemented carbide substrate 102 substantially infiltrates each of the first and second at least partially leached PCD cutting portions 402 and 408 so that the interstitial regions of the regions 414 and 416 are filled by the infiltrated metal-solvent catalyst. In such an embodiment, if desired, the infiltrated metal-solvent catalyst may be removed in a second leaching process from the regions 414 and 416 of the infiltrated first and second at least partially leached PCD cutting portions 402 and 408.

In another embodiment, the interstitial regions of the regions 414 and 416 may be infiltrated prior to, during, or after bonding the first and second at least partially leached PCD cutting portions 402 and 408 to the cemented carbide substrate 102. For example, respective layers of infiltrant (not shown) may be positioned adjacent to the front surfaces 404 and 410 of the first and second at least partially leached PCD cutting portions 402 and 408. Suitable infiltrants include a nonmetallic catalyst, silicon, a silicon-cobalt alloy, or another suitable infiltrant. For example, the nonmetallic catalyst may be selected from a carbonate (e.g., one or more carbonates of Li, Na, K, Be, Mg, Ca, Sr, and Ba), a sulfate (e.g., one or more sulfates of Be, Mg, Ca, Sr, and Ba), a hydroxide (e.g., one or more hydroxides of Be, Mg, Ca, Sr, and Ba), elemental phosphorous and/or a derivative thereof, a chloride (e.g., one or more chlorides of Li, Na, and K), elemental sulfur and/or a derivative thereof, a polycyclic aromatic hydrocarbon (e.g., naphthalene, anthracene, pentacene, perylene, coronene, or combinations of the foregoing) and/or a derivative thereof, a chlorinated hydrocarbon and/or a derivative thereof, a semiconductor material (e.g., germanium or a geranium alloy), and combinations of the foregoing. For example, one suitable carbonate catalyst is an alkali metal carbonate material including a mixture of sodium carbonate, lithium carbonate, and potassium carbonate that form a low-melting ternary eutectic system. This mixture and other suitable alkali metal carbonate materials are disclosed in U.S. patent application Ser. No. 12/185,457, which is incorporated herein, in its entirety, by this reference. The alkali metal carbonate material disposed in the interstitial regions of the regions 414 and 416 of the infiltrated first and second at least partially leached PCD cutting portions 402 and 408 may be partially or substantially completely converted to one or more corresponding alkali metal oxides by suitable heat treatment following infiltration.

As previously discussed, the infiltrant may be silicon or a silicon-cobalt alloy (e.g., cobalt silicide). In an embodiment, respective layers of infiltrant (not shown) each including silicon particles present in an amount of about 50 to about 60 wt % and cobalt particles present in an amount of about 40 to about 50 wt % may be positioned adjacent to the front surfaces 404 and 410 of the first and second at least partially leached PCD cutting portions 402 and 408. In a more specific embodiment, each infiltrant layer may include silicon particles and cobalt particles present in an amount of about equal to or near a eutectic composition of the silicon-cobalt chemical system. In some embodiments, the silicon particles and cobalt particles may be held together by an organic binder to form a green layer of cobalt and silicon particles. In another embodiment, each layer may comprise a thin sheet of a silicon-cobalt alloy or a green layer of silicon-cobalt alloy particles formed by mechanical alloying having a low-melting eutectic or near eutectic composition. The respective layers of infiltrant, the cemented carbide substrate 102, and the first and second at least partially leached PCD cutting portions 402 and 408 may be subjected to an HPHT process to infiltrate the regions 414 and 416 of the first and second at least partially leached PCD cutting portions 402 and 408 with material therefrom. After the HPHT process, the interstitial regions of the regions 414 and 416 may include silicon carbide, cobalt carbide, a mixed carbide of cobalt and silicon, or combinations of the foregoing disposed therein that are reaction products formed by the infiltrant reacting with the diamond grains. Also, substantially pure silicon, substantially pure cobalt, or a silicon-cobalt alloy (e.g., a cobalt silicide) may also be present in the interstitial regions of the regions 414 and 416 of the first and second at least partially leached PCD cutting portions 402 and 408.

Although not shown in FIGS. 3 and 4, the cemented carbide substrate 102 may be replaced with the cemented carbide substrate 202 (FIG. 2A). In such an embodiment, the through hole 208 may be loaded with diamond particles (i.e., diamond powder) or other superabrasive particles so that the superabrasive core 214 (FIG. 2A) is formed after HPHT processing.

The first and second at least partially leached PCD cutting portions 402 and 408 may be fabricated by subjecting a plurality of diamond particles to an HPHT sintering process in the presence of a metal-solvent catalyst (e.g., cobalt, nickel, iron, or alloys thereof) to facilitate intergrowth between the diamond particles and form a PCD body comprised of bonded diamond grains that exhibit diamond-to-diamond bonding therebetween. For example, the metal-solvent catalyst may be mixed with the diamond particles having any of the diamond particle sizes or distributions disclosed herein, infiltrated from a metal-solvent catalyst foil or powder adjacent to the diamond particles, infiltrated from a metal-solvent catalyst present in a cemented carbide substrate, or combinations of the foregoing. The bonded diamond grains, so-formed by HPHT sintering the diamond particles, define interstitial regions with the metal-solvent catalyst disposed within the interstitial regions.

The as-sintered PCD body may be leached by immersion in an acid, such as aqua regia, nitric acid, hydrofluoric acid, or subjected to another suitable process to remove at least a portion of the metal-solvent catalyst from the interstitial regions of the PCD body and form the first or second at least partially leached PCD cutting portion 402 or 408. For example, the as-sintered PCD body may be immersed in the acid for about 2 to about 7 days (e.g., about 3, 5, or 7 days) or for a few weeks (e.g., about 4 weeks) depending on the process employed. It is noted that when the metal-solvent catalyst is infiltrated into the diamond particles from a cemented tungsten carbide substrate including tungsten carbide particles cemented with a metal-solvent catalyst (e.g., cobalt, nickel, iron, or alloys thereof), the infiltrated metal-solvent catalyst may carry tungsten and/or tungsten carbide therewith and the as-sintered PCD body may include such tungsten and/or tungsten carbide therein disposed interstitially between the bonded diamond grains. The tungsten and/or tungsten carbide may not be substantially removed by the leaching process and may enhance the wear resistance of the first and second at least partially leached PCD cutting portions 402 and 408 so-formed.

The first and second at least partially leached PCD cutting portions 402 and 408 may be subjected to a shaping process prior to or subsequent to bonding to the cemented carbide substrate 102, such as grinding or lapping, to tailor the geometry thereof, as desired, for a particular application. For example, each of the first and second at least partially leached PCD cutting portions 402 and 408 may be chamfered prior to or subsequent to being bonded to the cemented carbide substrate 102. The as-sintered PCD body may also be shaped prior to or subsequent to leaching or bonding to the cemented carbide substrate 102 by a machining process, such as electro-discharge machining or grinding.

Figure 5A:
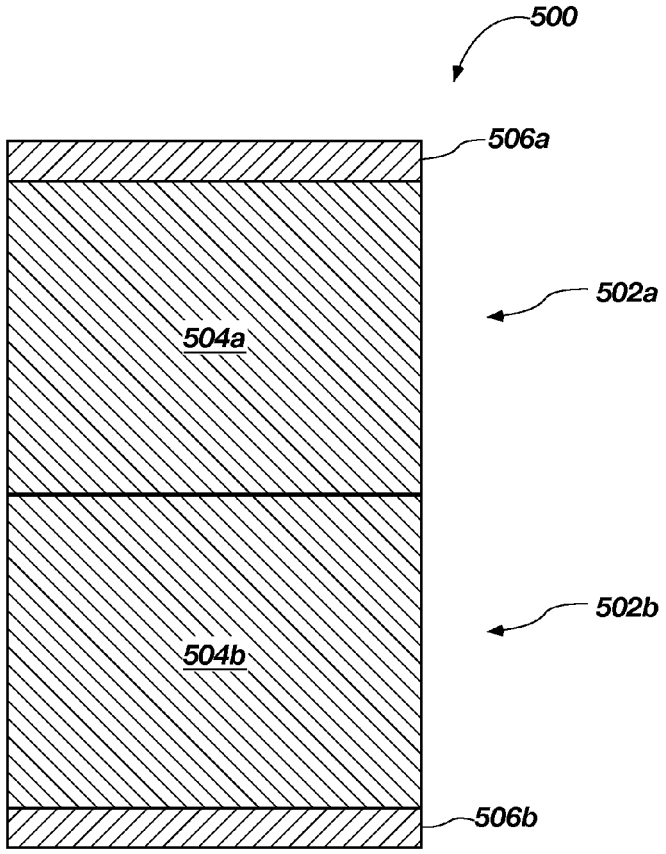
FIG. 5A is a cross-sectional view of a first superabrasive compact including a first cemented carbide substrate that has been bonded to a second cemented carbide substrate of a second superabrasive compact according to an embodiment.

FIG. 5A is a cross-sectional view of a superabrasive compact 500 formed by bonding two single-superabrasive cutting portion superabrasive compacts according to an embodiment. The superabrasive compact 500 includes a first superabrasive compact 502*a* bonded to a second superabrasive compact 502*b*. The first superabrasive compact 502*a* comprises a first cemented carbide substrate 504*a* including a first superabrasive cutting portion 506*a* bonded thereto. The second superabrasive compact 502*b* comprises a second cemented carbide substrate 504*b* including a second superabrasive cutting portion 506*b* bonded thereto. Each of the first and second superabrasive cutting portions 506*a* and 506*b* may be a pre-sintered PCD cutting portion, a PCD cutting portion integrally formed with the cemented carbide substrate 502*a* or 502*b* by sintering diamond particles thereon, or another disclosed superabrasive cutting portion. Each of the first and second cemented carbide substrates 504*a* and 504*b* may be made from the same materials as the cemented carbide substrate 102 discussed hereinabove.

Figure 5B:
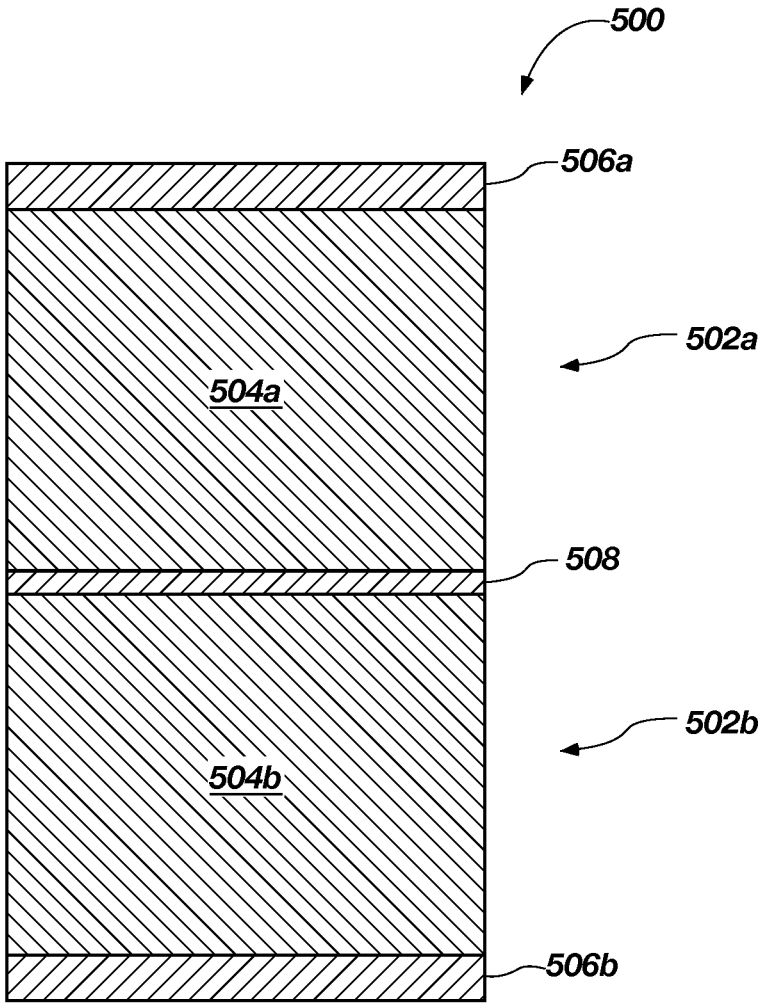
FIG. 5B is a cross-sectional view of a first superabrasive compact including a first cemented carbide substrate that has been brazed to a second cemented carbide substrate of a second superabrasive compact according to an embodiment.

The first and second cemented carbide substrates 504*a* and 504*b* may be joined together via a diffusion-bonding process, an HPHT bonding process, or another suitable joining process. For example, the first and second superabrasive compacts 502*a* and 502*b* may be stacked with the first and second cemented carbide substrates 504*a* and 504*b* abutting each other and subjected to a diffusion-bonding process under non-diamond-stable pressure/temperature conditions or an HPHT process under diamond-stable pressure/temperature conditions. Referring to FIG. 5B, in another embodiment, the first and second cemented carbide substrates 504*a* and 504*b* may be brazed together with a layer of braze alloy 508.

Figure 6A:
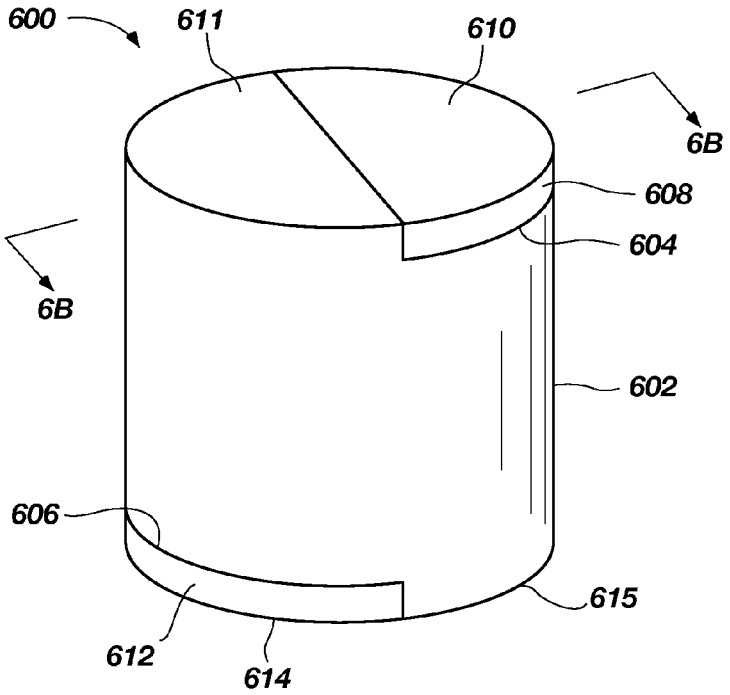
FIG. 6A is an isometric view of a superabrasive compact including first and second superabrasive cutting portions that are laterally offset from each other according to an embodiment
Figure 6B:
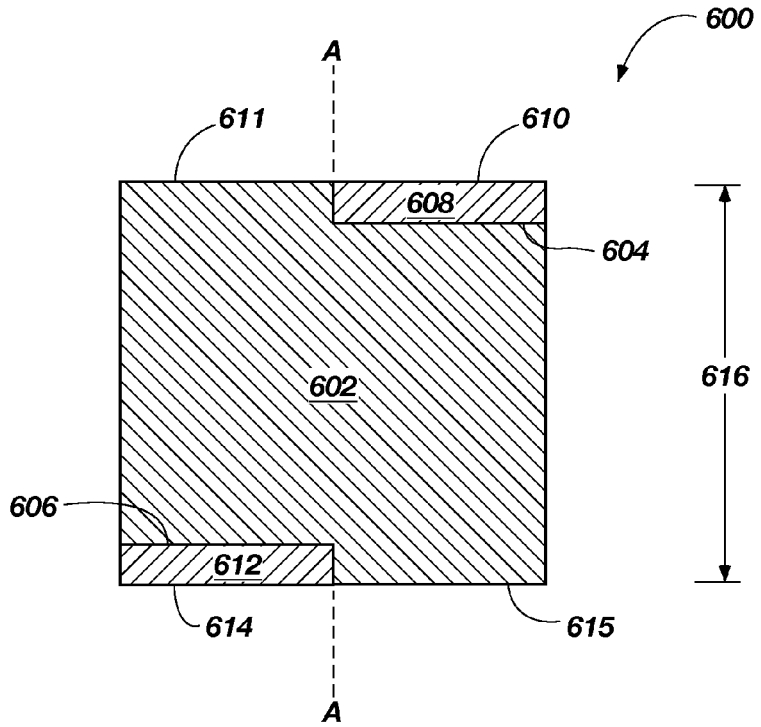
FIG. 6B is a cross-sectional view of the superabrasive compact shown in FIG. 6A taken along line 6B-6B.

FIGS. 6A and 6B are isometric and cross-sectional views, respectively, of a superabrasive compact 600 including multiple superabrasive cutting portions that are laterally offset from each other according to an embodiment. The superabrasive compact 600 may include more substrate-surface area for brazing into a recess of a drill-bit body than, for example, the superabrasive compact 100 shown in FIGS. 1A and 1B. The superabrasive compact 600 comprises a cemented carbide substrate 602 defining an axis A, such as a longitudinal axis. The cemented carbide substrate 602 includes a first recess 604 laterally offset about the axis A from a second recess 606. The cemented carbide substrate 602 may be made from the same materials as the cemented carbide substrate 102 discussed hereinabove.

A first superabrasive cutting portion 608 may be disposed in the first recess 604. A front surface 610 of the first superabrasive cutting portion 608 may be substantially coplanar with a laterally adjacent surface 611 of the cemented carbide substrate 602. A second superabrasive cutting portion 612 may be disposed in the second recess 606. A front surface 614 of the second superabrasive cutting portion 612 may be substantially coplanar with a laterally adjacent surface 615 of the cemented carbide substrate 602. The exposed front surfaces 611 and 615 of the cemented carbide substrate 602 provide brazeable surfaces for brazing the superabrasive compact 600 into a recess of a drill-bit body. The first and second superabrasive cutting portions 608 and 612 may be spaced to define a dimension 616 of the superabrasive compact 600. The first and second superabrasive cutting portions 608 and 612 may each be a pre-sintered PCD cutting portion, PCD cutting portion integrally formed with the cemented carbide substrate 602 from un-bonded diamond particles (e.g., diamond powder), or another disclosed superabrasive cutting portion.

Figure 6C:
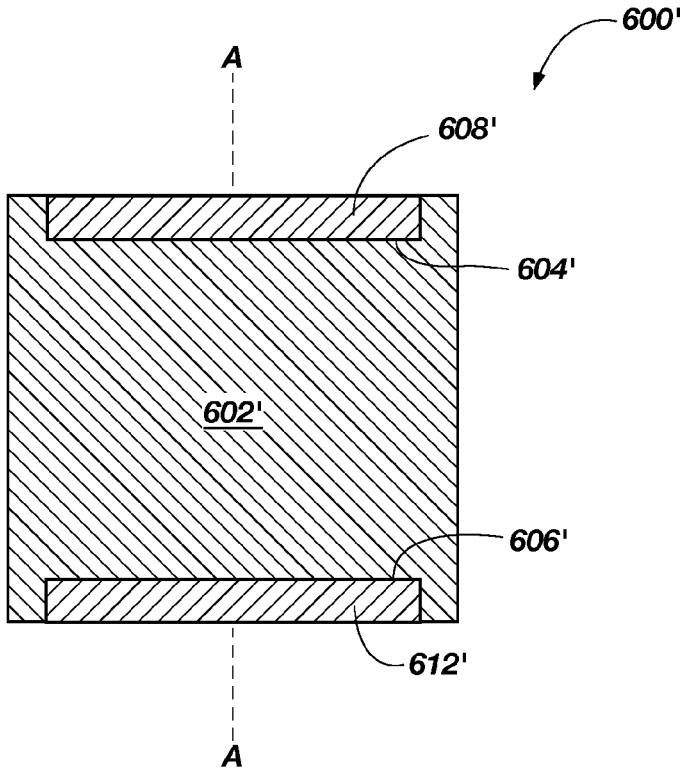
FIG. 6C is a cross-sectional view of a superabrasive compact according to another embodiment.
Figure 6D:
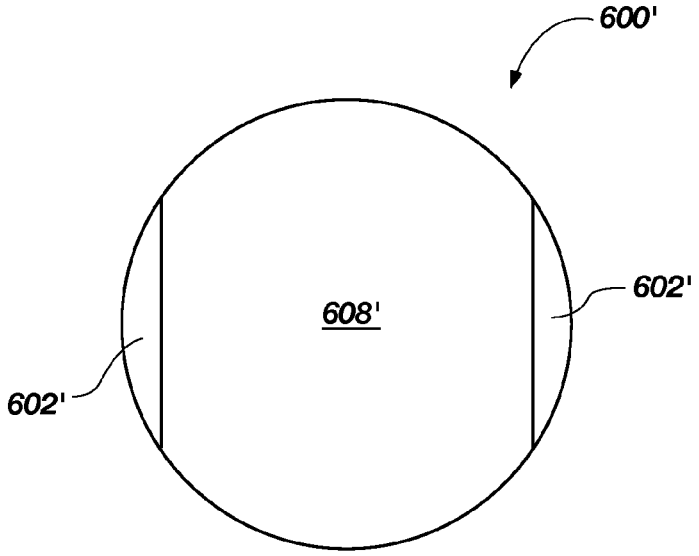
FIG. 6D is a top plan view of the superabrasive compact shown in FIG. 6C.

In another embodiment, the first and second recesses 604 and 606 may be generally centered about the axis A. Referring to FIGS. 6C and 6D, a superabrasive compact 600' comprises a cemented carbide substrate 602' including a first recess 604' formed therein and a second recess 606' formed therein. Each of the first and second recesses 604' and 606' may be generally centered about the longitudinal axis A. A first superabrasive cutting portion 608' may be disposed in the first recess 604' and a second superabrasive cutting portion 612' may be disposed in the second recess 606'. Exposed front surfaces of the cemented carbide substrate 602' that flank the first and second superabrasive cutting portions 608' and 612' may provide increased surface area for brazing the PDC 600' into a recess formed in a drill-bit body compared to the PDC 100 shown in FIGS. 1A and 1B.

Figure 7:
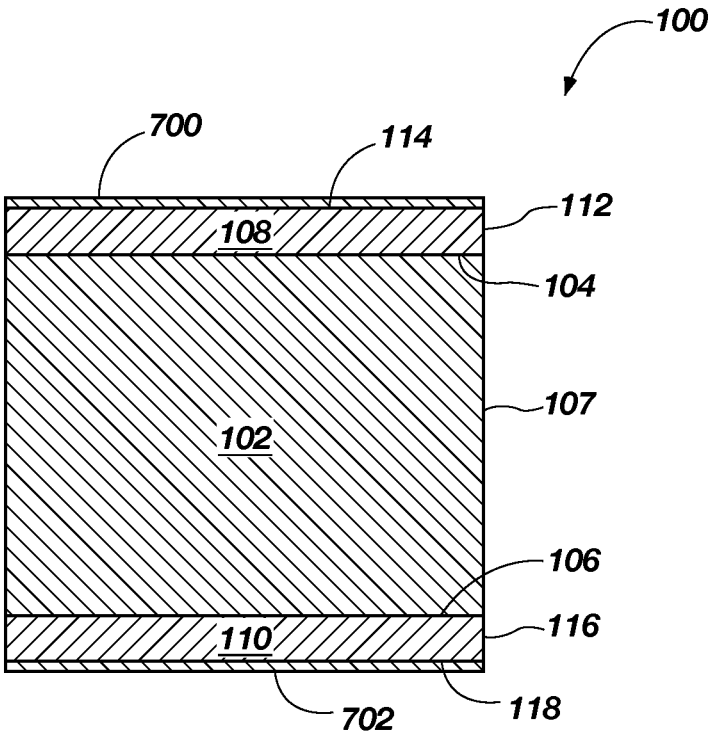
FIG. 7 is a cross-sectional view of the superabrasive compact including brazeable layers coating at least a portion of respective superabrasive cutting portions to enhance brazeability thereof according to an embodiment.

FIG. 7 is a cross-sectional view of the superabrasive compact 100 including brazeable layers 700 and 702 to enhance brazeability of the superabrasive compact 100 according to an embodiment. The brazeable layer 700 may coat at least a portion of the front surface 114 of the superabrasive cutting portion 108. The brazeable layer 702 may coat at least a portion of the front surface 118 of the superabrasive cutting portion 110. During use, the exposed one of the brazeable layers 700 or 702 may be easily worn away during drilling operations, while the unexposed one of the brazeable layers 700 or 702 is brazed to a drill-bit body. As an alternative or in addition to, in an embodiment, a brazeable layer may coat at least a portion of the at least one peripheral surface 107.

In an embodiment, the brazeable layers 700 and 702 may each be made from a binderless tungsten carbide material that is deposited by chemical vapor deposition ("CVD") or physical vapor deposition ("PVD"). The binderless tungsten carbide material includes a plurality of bonded tungsten carbide grains and is substantially free of a cementing constituent (i.e., a binder), such as cobalt or other diamond-catalyzing material, that cements the tungsten carbide grains together. In an embodiment, the binderless tungsten carbide may be formed by CVD or variants thereof (e.g., plasma-enhanced CVD, etc.), without limitation. Specifically, one example of a commercially available CVD tungsten carbide layer (currently marketed under the trademark HARDIDE®) is currently available from Hardide Layers Inc. of Houston, Tex. In other embodiments, the binderless tungsten carbide may be formed by PVD, variants of PVD, high-velocity oxygen fuel ("HVOF") thermal spray processes, or any other suitable process, without limitation.

In another embodiment, the brazeable layers 700 and 702 may be made from a metallic material (e.g., a metal or an alloy) that is deposited by, for example, sputtering or another suitable PVD, CVD, electroless, or electroplating process. For example, the metallic material may be a material, such as iron, nickel, copper, tungsten, alloys of the foregoing metals, or another suitable metal or alloy. In an embodiment, the metallic material may not be catalytic relative to diamond so that the thermal stability of the superabrasive cutting portions 108 and 110 is not substantially compromised.

Figure 8A:
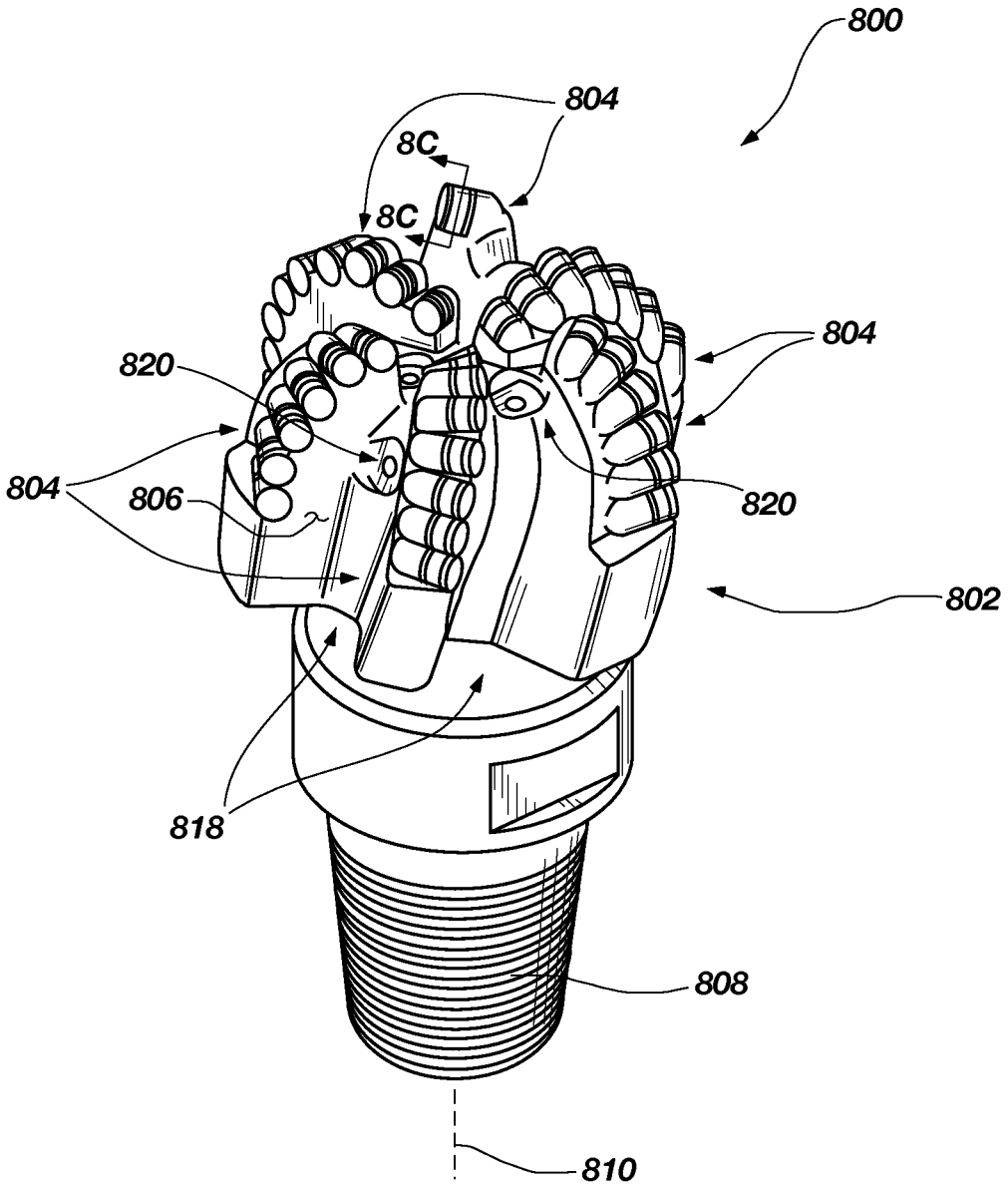
FIG. 8A is an isometric view of an embodiment of a rotary drill bit that may employ one or more of the disclosed superabrasive compact embodiments.
Figure 8B:
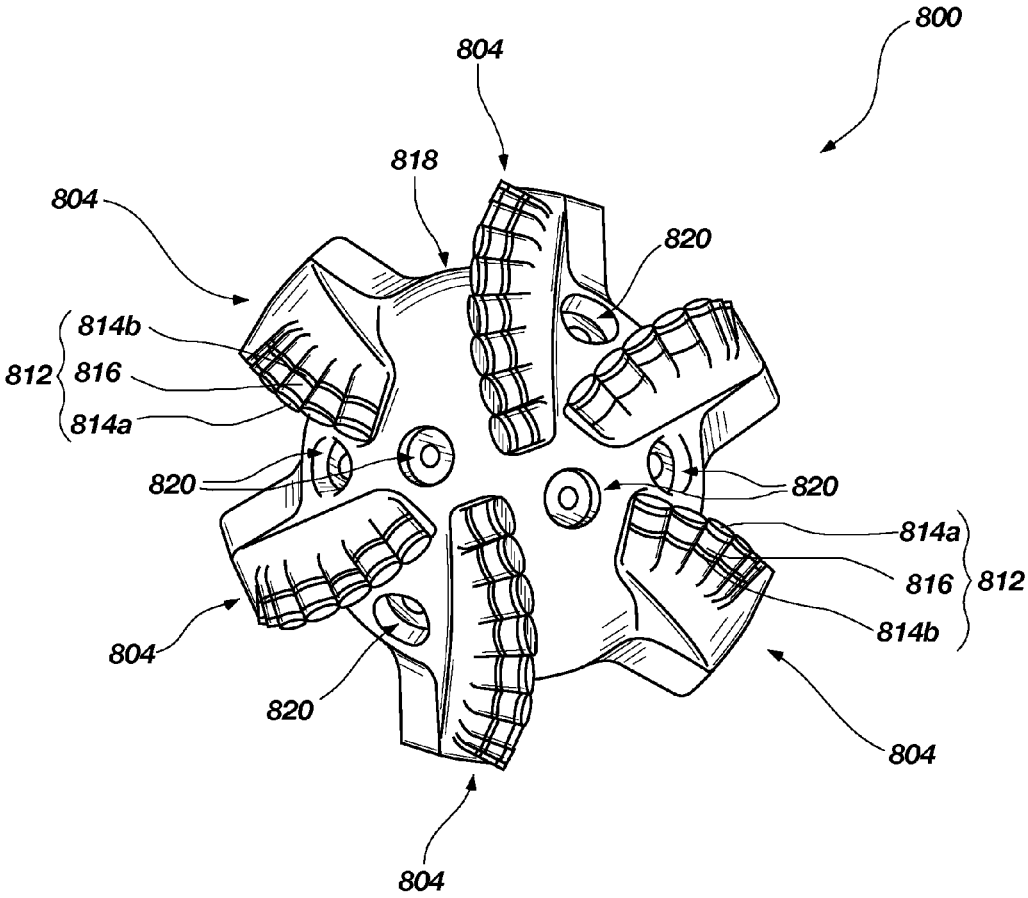
FIG. 8B is a top elevation view of the rotary drill bit shown in FIG. 8A.

FIG. 8A is an isometric view and FIG. 8B is a top elevation view of an embodiment of a rotary drill bit 800 that includes at least one superabrasive compact configured according to any of the disclosed superabrasive compact embodiments. The rotary drill bit 800 comprises a bit body 802 that includes radially and longitudinally extending blades 804 having leading faces 806, and a threaded pin connection 808 for connecting the bit body 802 to a drilling string. The bit body 802 defines a leading end structure for drilling into a subterranean formation by rotation about a longitudinal axis 810 and application of weight-on-bit. At least one superabrasive compact, configured according to any of the previously described superabrasive compact embodiments, may be affixed to the bit body 802. With reference to FIG. 8B, a plurality of superabrasive compacts 812 are secured to the blades 804 of the bit body 802. For example, each superabrasive compact 812 may include first and second superabrasive cutting portions 814*a* and 814*b* bonded to a cemented carbide substrate 816. More generally, the superabrasive compacts 812 may comprise any superabrasive compact disclosed herein, without limitation. In addition, if desired, in some embodiments, a number of the superabrasive compact 812 may be conventional in construction. Also, circumferentially adjacent blades 804 define so-called junk slots 820 therebetween. Additionally, the rotary drill bit 800 includes a plurality of nozzle cavities 818 for communicating drilling fluid from the interior of the rotary drill bit 800 to the superabrasive compacts 812.

Figure 8C:
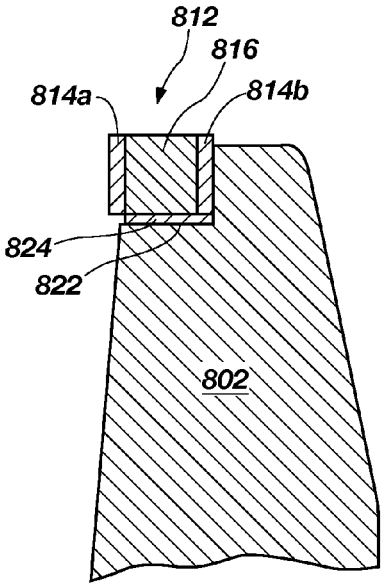
FIG. 8C is a partial cross-sectional view of one of the superabrasive compact and the bit body taken through line 8C-8C shown in FIGS. 8A and 8B.

The disclosed PDC embodiments that include dual superabrasive cutting portions may help prevent damage to a recess formed in a bit body in which a superabrasive compact is brazed. For example, referring to FIG. 8C, which is a partial cross-sectional view through one of the superabrasive compacts 812 shown in FIGS. 8A and 8B, each superabrasive compact 812 may be brazed in a recess 822 with a braze alloy 824. The second superabrasive cutting portion 814*b* of the superabrasive compact 812 may help prevent damage to portion of the bit body 802 defining the recess 822 formed. During use, when the first superabrasive cutting portion 814*a* is worn, the superabrasive compact 812 may be removed and re-brazed into the recess 822 with the second superabrasive compact cutting portion 814*b* positioned to cut a subterranean formation during drilling.

FIGS. 8A and 8B merely depict one embodiment of a rotary drill bit that employs at least one superabrasive compact fabricated and structured in accordance with the disclosed embodiments, without limitation. The rotary drill bit 800 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The superabrasive compacts disclosed herein (e.g., superabrasive compact 100 of FIG. 1 or the superabrasive compact 400 of FIG. 4) may also be utilized in applications other than cutting technology. For example, the disclosed superabrasive compact embodiments may be used in wire dies, bearings, artificial joints, inserts, cutting elements, and heat sinks. Thus, any of the superabrasive compacts disclosed herein may be employed in an article of manufacture including at least one superabrasive element or compact.

Thus, the embodiments of superabrasive compacts disclosed herein may be used in any apparatus or structure in which at least one conventional superabrasive compact is typically used. In one embodiment, a rotor and a stator, assembled to form a thrust-bearing apparatus, may each include one or more superabrasive compacts (e.g., superabrasive compact 100 of FIG. 1 or the superabrasive compact 400 of FIG. 4) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of superabrasive compacts disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the superabrasive compacts disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; 6,793,681; and 5,180,022, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

What is claimed is:

1. A method of repairing a rotary drill bit, comprising:

providing the rotary drill bit, the rotary drill bit including a bit body having a plurality of superabrasive cutting elements brazed thereto, at least one of the plurality of superabrasive cutting elements defining a longitudinal axis and including:

a cemented carbide substrate including a first end having a first surface adjacent to a first recess and a second end having a second surface adjacent to a second recess, the first end being spaced from the second end along the longitudinal axis;

a first superabrasive cutting portion bonded at least partially within the first recess of the cemented carbide substrate, the first superabrasive cutting portion including a first working surface facing in a first direction; and a second superabrasive cutting portion bonded at least partially within the second recess of the cemented carbide substrate and axially spaced from the first superabrasive cutting portion, the second superabrasive cutting portion including a second working surface laterally offset from the first working surface and facing in a second direction that is generally opposite to the first direction;

removing the at least one of the plurality of superabrasive cutting elements from the bit body when the first superabrasive cutting portion is at least partially worn; and after the act of removing, brazing the at least one of the plurality of superabrasive cutting elements to the bit body with the second superabrasive cutting portion positioned for cutting a subterranean formation during drilling.

2. The method of claim 1 wherein at least one of the first superabrasive cutting portion or the second superabrasive cutting portion comprises a leached region from which a metallic material is at least partially removed.

3. The method of claim 1 wherein at least one of the first or second superabrasive cutting portions comprises a polycrystalline diamond cutting portion integrally formed with the cemented carbide substrate.

4. The method of claim 1 wherein at least one of the first or second superabrasive cutting portions comprises a preformed polycrystalline diamond cutting portion.

5. The method of claim 1 wherein:

the first superabrasive cutting portion comprises at least one first lateral surface and a first cutting edge that generally defines part of a circle, at least a portion of the at least one first lateral surface bonded to the cemented carbide substrate; and the second superabrasive cutting portion comprises at least one second lateral surface and a second cutting edge that generally defines part of a circle, at least a portion of the at least one second lateral surface bonded to the cemented carbide substrate.

6. The method of claim 1 wherein:

the first surface comprises a top surface and the second surface comprises a bottom surface;

the first superabrasive cutting portion including at least one first lateral surface and a first cutting edge that generally defines part of a circle, wherein at least a portion of the at least one first lateral surface is bonded to the cemented carbide substrate; and the second superabrasive cutting portion including at least one second lateral surface and a second cutting edge that generally defines part of a circle, wherein at least a portion of the at least one second lateral surface is bonded to the cemented carbide substrate;

the first working surface of the first superabrasive cutting portion and the top surface of the cemented carbide substrate at least partially defining an upper surface of the at least one of the plurality of superabrasive cutting elements; and the second working surface of the second superabrasive cutting portion and the bottom surface of the cemented carbide substrate at least partially defining a lower surface of the at least one of the plurality of superabrasive cutting elements.

7. The method of claim 1 wherein the cemented carbide substrate comprises:

a first cemented carbide substrate including the first recess; and a second cemented carbide substrate including the second recess, the second cemented carbide substrate bonded to the first cemented carbide substrate.

8. The method of claim 7 wherein the first cemented carbide substrate is diffusion bonded to the second cemented carbide substrate.

9. The method of claim 7 wherein the first cemented carbide substrate is brazed to the second cemented carbide substrate.

10. The method of claim 1 wherein a superabrasive structure is not disposed on or in at least one peripheral surface of the cemented carbide substrate.

11. The method of claim 1 wherein the first working surface defines a portion of an upper surface of the at least one of the plurality of superabrasive cutting elements, and the second working surface defines a portion of a lower surface of the at least one of the plurality of superabrasive cutting elements.

12. A method of reconstructing a rotary drill bit, comprising:

receiving the rotary drill bit that includes a bit body having a plurality of polycrystalline diamond cutting elements attached thereto, at least one of the plurality of polycrystalline diamond cutting elements brazed within a recess, the at least one of the plurality of polycrystalline diamond cutting elements defining a longitudinal axis and including:

a cemented carbide substrate including a first end having a first surface adjacent to a first recess and a second end having a second surface adjacent to a second recess axially, the first end being spaced from the second end along the longitudinal axis;

a first polycrystalline diamond cutting portion bonded at least partially within the first recess of the cemented carbide substrate, the first polycrystalline diamond cutting portion including a first working surface facing in a first direction; and a second polycrystalline diamond cutting portion bonded at least partially within the second recess of the cemented carbide substrate and axially spaced from the first polycrystalline diamond cutting portion, the second polycrystalline diamond cutting portion including a second working surface laterally offset from the first working surface and facing in a second direction that is generally opposite to the first direction;

removing the at least one of the plurality of polycrystalline diamond cutting elements from the bit body when the first polycrystalline diamond cutting portion is at least partially worn; and after the act of removing, brazing the at least one of the plurality of polycrystalline diamond cutting elements within the recess with the second polycrystalline diamond cutting portion positioned for cutting a subterranean formation during drilling.

13. The method of claim 12 wherein at least one of the first or second polycrystalline diamond cutting portions comprises a polycrystalline diamond cutting portion integrally formed with the cemented carbide substrate.

14. The method of claim 12 wherein at least one of the first or second polycrystalline diamond cutting portions comprises a preformed polycrystalline diamond cutting portion.

15. The method of claim 12 wherein:

the first polycrystalline diamond cutting portion comprises at least one first lateral surface and a first cutting edge that generally defines part of a circle, at least a portion of the at least one first lateral surface bonded to the cemented carbide substrate; and the second polycrystalline diamond cutting portion comprises at least one second lateral surface and a second cutting edge that generally defines part of a circle, at least a portion of the at least one second lateral surface bonded to the cemented carbide substrate.

16. The method of claim 1 wherein at least one of the first polycrystalline diamond cutting portion or the second polycrystalline diamond cutting portion comprises a leached region from which a metallic material is at least partially removed.

17. The method of claim 12 wherein:

the first surface comprises a top surface and the second surface comprises a bottom surface;

the first polycrystalline diamond cutting portion including at least one first lateral surface and a first cutting edge that generally defines part of a circle, wherein at least a portion of the at least one first lateral surface is bonded to the cemented carbide substrate; and the second polycrystalline diamond cutting portion including at least one second lateral surface and a second cutting edge that generally defines part of a circle, wherein at least a portion of the at least one second lateral surface is bonded to the cemented carbide substrate;

the first working surface of the first polycrystalline diamond cutting portion and the top surface of the cemented carbide substrate at least partially defining an upper surface of the at least one of the plurality of polycrystalline diamond cutting elements; and the second working surface of the second polycrystalline diamond cutting portion and the bottom surface of the cemented carbide substrate at least partially defining a lower surface of the at least one of the plurality of polycrystalline diamond cutting elements.

18. The method of claim 12 wherein the first working surface defines a portion of an upper surface of the at least one of the plurality of polycrystalline diamond cutting elements, and the second working surface defines a portion of a lower surface of the at least one of the plurality of polycrystalline diamond cutting elements.

19. A method of repairing a subterranean drill system component, comprising:

receiving a rotary drill bit comprising a bit body including a plurality of blades having a plurality of polycrystalline diamond cutting elements brazed thereto, at least one of the plurality of polycrystalline diamond cutting elements defining a longitudinal axis and including:

a substrate including a first end having a first surface adjacent to a first recess and a second end having a second surface adjacent to a second recess that is spaced laterally from the first recess, the first end being spaced from the second end along the longitudinal axis;

a first polycrystalline diamond cutting portion bonded at least partially within the first recess of the substrate, the first polycrystalline diamond cutting portion including a first working surface facing in a first direction and a first cutting edge that generally defines part of a circle; and a second polycrystalline diamond cutting portion bonded at least partially within the second recess of the substrate and axially spaced from the first polycrystalline diamond cutting portion, the second polycrystalline diamond cutting portion including a second working surface laterally offset from the first working surface and facing in a second direction that is generally opposing the first direction and a second cutting edge that generally defines part of a circle;

removing the at least one of the plurality of polycrystalline diamond cutting elements from the bit body when the first polycrystalline diamond cutting portion is at least partially worn; and after the act of removing, re-attaching the at least one of the plurality of polycrystalline diamond cutting elements to the bit body with the second polycrystalline diamond cutting portion positioned for cutting a subterranean formation during drilling.

20. The method of claim 19 wherein at least one of the first polycrystalline diamond cutting portion or the second polycrystalline diamond cutting portion comprises a leached region from which a metallic material is at least partially removed.

* * * * *